United States Patent [19]

Dokoupil et al.

[11] 4,065,943

[45] Jan. 3, 1978

[54] ROTARY IRONING MACHINE

[75] Inventors: Jiri Dokoupil, Guckingen; Horst Zäpfel, Karlsruhe; Erich Gabelmann, Karlsruhe; Helmut Breitwieser, Karlsruhe, all of Germany

[73] Assignee: Badische Maschinenfabrik GmbH, Germany

[21] Appl. No.: 690,502

[22] Filed: May 27, 1976

[30] Foreign Application Priority Data

May 30, 1975 Germany ..... 2524018

[51] Int. Cl.[2] ..... C14B 1/08

[52] U.S. Cl. ..... 69/41

[58] Field of Search ..... 69/43, 41, 2; 29/129.5, 29/130; 38/44, 49, 100, 101

[56] References Cited

U.S. PATENT DOCUMENTS

| | | | |
|---|---|---|---|
| 2,434,367 | 1/1948 | Moffatt et al. | 69/43 |
| 2,601,550 | 6/1952 | Nau-Touron | 29/130 X |
| 3,365,774 | 1/1968 | Kusters | 29/129.5 X |
| 3,587,258 | 6/1971 | Plechac | 69/43 |

*Primary Examiner*—Alfred R. Guest
*Attorney, Agent, or Firm*—Craig & Antonelli

[57] ABSTRACT

In a rotary ironing machine for applying treatments such as ironing, embossing and the like to sheet materials such as leather, cardboard and the like, the cylindrical ironing surface is provided on a thin-walled hollow cylinder, the sheet material is fed by a conveyor belt between said cylinder and an external pressure roller, a counter-pressure roller being provided within the cylinder. Radiation heating means are provided for the ironing surface, externally or preferably internally of the hollow cylinder. Said cylinder is supported by external or internal guide rollers which, together with the heating arrangement, are supported by a carrier which is disposed within the cylinder and is supported at only one end thereof. Other details are disclosed, including a retaining arrangement, for retaining and spreading the sheet material and stripping arrangements with oscillating stripper fingers.

23 Claims, 7 Drawing Figures

FIG. 7
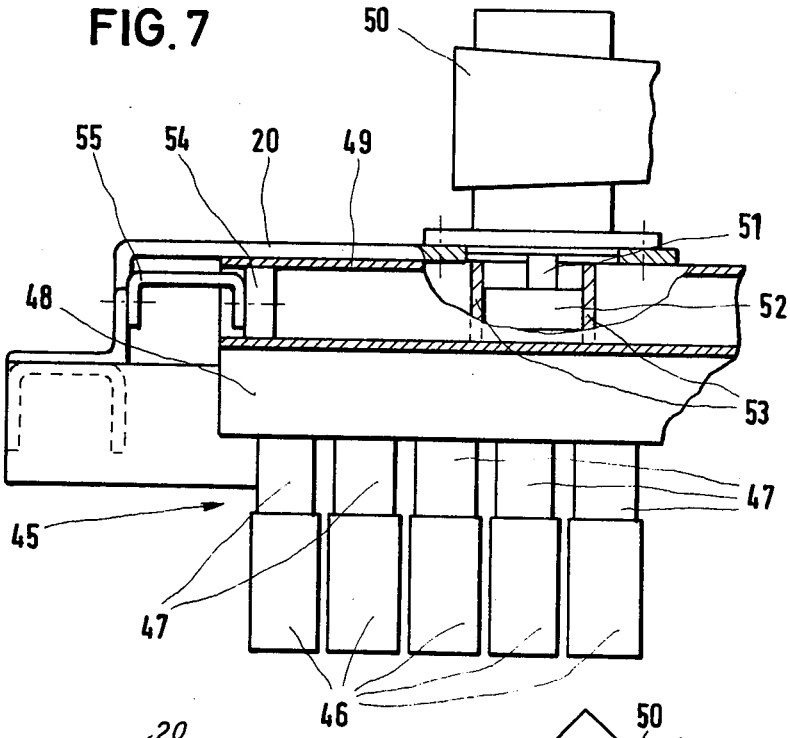
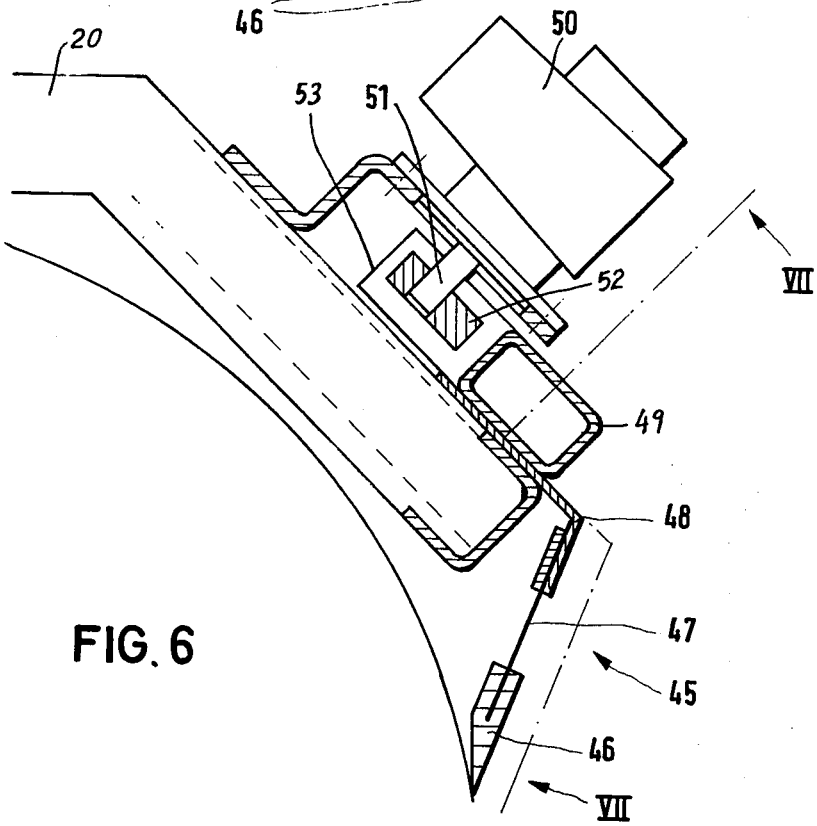
FIG. 6

ROTARY IRONING MACHINE

The present invention relates to machines for applying treatments such as ironing, embossing, and the like for sheet materials such as leather. In particular, it relates to such machines of the general type known as cylinder machines, having a cylindrical ironing surface, embossed where appropriate, a pressure cylinder or roller, a conveyor belt which guides the leather between the ironing surface and the pressure cylinder, and heating means for heating the ironing surface.

Ironing of leather calls for the application of high pressures at elevated temperature with the consequence that the ironing surfaces must not only have a high-quality surface finish but must also meet increased requirements in terms of thermal stability and mechanical strength. Satisfying these requirements does not present any special difficulties in machines with flat ironing surfaces (for example, as in the British patent specification No. 1,346,649) since flat pressure platens and mating or counter-pressure platens, of which at least one is heated, can be provided in such a machine. However, ironing machines of this kind do not operate continuously, although an attempt has already been made to achieve longitudinal feed by imparting vibratory motion to one of the platens. However, this is not successful in practice.

Cylinder machines, of the type mentioned above, are known for continuous operation (U.S. Pat. No. 3,587,258). In these machines the leather, laid on an endless conveyor belt, is guided between an ironing cylinder and two outer pressure rollers and there subjected to elevated temperature and high pressure. The ironing cylinder is therefore directly heated from the interior by a fluid and the pressure rollers are braced by means of bracing jacks to the shaft of the ironing cylinder in order to produce the ironing pressure. The shaft of the ironing cylinder is supported on only one side.

In these ironing machines it is important to be able to adapt the temperature rapidly to the leather that is being processed or to the desired embossing effect, i.e. the heat must be supplied rapidly and it must be rapidly dissipated so that another temperature can be set up. When such an ironing machine is also used for embossing, it is important to find an ironing surface construction which, on the one hand, can be rapidly exchanged for ironing surfaces with other embossings and, on the other hand, is not too costly.

In the known machine (U.S. Pat. No. 3,587,258), this problem is supposed to be solved by making the driven ironing cylinder comprise an exchangeable cylinder barrel or shell, the outside of which has the ironing or embossing surface and the inside of which is provided with the entire heating device. This cylinder barrel is clamped, by means of wedge surfaces, to two end flanges of the cylinder. The barrel can be removed when the wedges are slackened. To this end, it is also necessary to slacken the bracing elements between the pressure cylinders and the shaft of the ironing cylinder so that the cylinder barrel with the integrated heating device can be withdrawn from the end flanges and can be replaced with a new cylinder barrel and heating device.

This construction is very complex because precise centering of the cylinder barrel on the end flanges encounters some difficulties, more particularly since the construction of the end flanges themselves must be correspondingly complex. The cylinder barrels with the heating device must be constructed in heavy and solid form so that they can withstand the ironing pressure. On the other hand, each individual ironing or embossing cylinder must be equipped with its own heating device. This greatly increases the cost of the machine.

It is an object of the invention to provide a construction which, on the one hand, enables the temperature to be changed in the shortest possible time and, on the other hand, permits simple installation and removal of the ironing surface. Furthermore, it is desirable to avoid the formation of folds in the leather, which frequently occurs in the known ironing machines, when the leather is passed into the ironing gap and when it is stripped from the ironing surface.

According to the invention, the ironing surface is defined by a thin-walled hollow cylinder and the heating means is constructed as a heating arrangement which acts on the said cylinder by radiation from the exterior or the interior, and a mating or counter-pressure roller, which rolls upon the internal wall of the hollow cylinder, is disposed therein and guides together with a pressure roller the hollow cylinder, the feed belt and the leather roller in the roll gap between the pressure roller and the counter pressure roller.

Accordingly, the ironing surface is constructed as a simple thin-walled hollow cylinder the sole purpose of which is to provide the smooth or embossed surface required for ironing or embossing. The ironing pressure or embossing pressure on the other hand is produced exclusively by the pressure roller and the counter pressure roller between which the hollow cylinder is guided and by means of which it is set into rotation. The ironing cylinder itself is hardly exposed to any stresses, more particularly it is not exposed to any bending stresses which are absorbed exclusively by the two smaller rollers and can be readily controlled thereby. The other advantage resides in the comparatively low thermal capacity of the hollow cylinder, due to its thin walls, so that the installed heating power need only be low. Furthermore, the said hollow cylinder rapidly transfers its heat to the leather. Because of its low mass, the hollow cylinder also cools rapidly. The accuracy of temperature control is assisted by the low mass. Finally, the said hollow cylinder can be readily exchanged. Since the hollow cylinder is merely a simple cylindrical sheet metal plate, it is possible to change from ironing to embossing or to change between different embossing effects with low costs even in the case of small batches. The hollow cylinder of large diameter and the feed belt ensure that the leather is spread in the course of the feed motion, i.e. that it run onto the cylinder without being folded.

According to one advantageous embodiment of the invention, the interior and/or exterior of the hollow cylinder is guided centrally with respect to its axis by means of stationary guide rollers or the like. The hollow cylinder therefore rotates like an ironing cylinder but without having its heavy construction or a drive.

The heating device is advantageously constructed as a radiating heating device and is disposed on an arc at a distance from the internal wall of the hollow cylinder. Generally, this arrangement is located approximately diametrically opposite to the two pressure rollers within but preferably in front of the feed region in which the leather enters the gap between the hollow cylinder and the feed belt. Prior to reaching the pressure rollers, the leather is therefore heated and raised to the desired temperature since the heated section of the hollow cylinder travels with the leather. Compared with previously used heating systems the radiating heating system offers the advantage of reaching temperature which are higher than those obtained with oil as thermal medium, while nevertheless permitting rapid cooling.

In an ironing machine with the construction as described hereinbefore in which the skin is guided through cylinders or similar processing tools and is therefore substantially subjected only to one pressure, it is necessary for the skin to be spread and tensioned manually on the feeder belt which supplies the skin. Spreading and tensioning of the skin must be performed with great care because any fold or bubble formed thereby is pressed into the leather by the pressure of the processing tools and cannot subsequently be removed. Such a skin is substantially useless or only the flawless parts thereof can be used.

Folds, more particularly in the outer region of the skin, can hardly be avoided even if the skin has been carefully spread. This fault is due not only to the irregular contour of the entire skin but also to its varying mass distribution. The relative velocity between the ironing cylinder and the skin is constant over the entire length within the processing zone. Due to the larger amount of material in the outer region of the skin, it accumulates in this region and forms folds after entering in the feed region of the processing tools, but the occurrence of such folds cannot be discovered from the outside and cannot be prevented.

To prevent such folds being formed and to obviate the need for manual spreading, the invention proposes a retaining roller disposed directly in front of a roller around which the feed belt passes at the feed station at which the skins are fed to the machine, said retaining roller extends at least over the middle region of the roller which reverses the feeder belt.

The leading portion of the skin is laid on the feeder belt at the feed station and the trailing portion of the skin hangs downwardly over the retaining roller. If the skin then enters the processing gap the operator places his hand firmly on the skin in the region of the brake cylinder with the result that the middle region of the skin is held back with respect to the outer regions and is thus stretched. By selecting the contact pressure the operator is able to adapt the retaining action on the middle region of the skin to the appropriate conditions. Advantageously, the retaining roller has a relatively small diameter, for example 50 mm, so that it can be easily gripped by the operator. Practical tests have shown that after the preceding conventional spreading of the skin the folds which are then still formed do not occur in the outer regions of the skin.

According to another feature of the invention, one further roller extending outwardly from the retaining roller is situated on each side of it. This construction enables the operator to retain or stretch the skin optionally in different regions.

In the preferred embodiment of this feature, the two side rollers extend from the retaining roller at a downward angle to the outside. This angle of inclination causes the outer region of the skin to hand downwards. The entrainment of the side rollers, their angle of inclination and the friction between them and the skin feeds the skin outwardly and spreads it. This dispenses with the previously necessary manual spreading of the skin on the feeder belt and manual work as well as any risk of accident associated therewith is minimized.

The retaining roller and the side rollers can be supported in a common frame. To this end, the retaining roller and the side rollers are loosely supported on different shaft angularly related in the region of the side rollers and supported on the frame between the said rollers.

According to another embodiment of the invention, the retaining roller can be divided into two or more loosely rotatably supported roller sections, to enable specific regions to be optionally decelerated within the middle region of the skin.

A frame of this kind with the retaining roller and the side rollers can also be attached to all other leather processing machines with rotating processing tools, for example machines for stetching or abrading of leather.

The heat required for ironing causes the leather to stick on the ironing cylinder, more particularly in the case of patent leather or dyed leather. Strippers in the form of stripper surfaces which extend over the entire processing width and bear by means of a sharp edge upon the ironing cylinder are known for detaching the ironed leather from the ironing cylinder.

Practical experience has shown that such strippers are unable to reliably detach fine, i.e. thin leather, from the ironing cylinder. Instead, the leather is built up on the stripper, forms folds and is creased.

According to the invention, this is avoided in that the stripper comprises a plurality of stripper fingers which are distributed over the processing width and are oscillatingly driven parallel to the axis of the ironing cylinder. Practical experience has shown that even extremely thin leather can be "peeled off" the ironing cylinder without forming folds. The oscillating motion in conjunction with the rotating motion of the ironing cylinder results in a relative peeling motion at an angle across the ironing cylinder, this motion being evidently responsible for the fact that even thin leather does not form any folds on the stripper.

Advantageously, the stripper fingers are mounted on a common rail which extends over the processing length width, said rail being oscillatingly driven. The stripper fingers can be mounted on leaf springs which in turn are mounted on the rail. A simple eccentric device which drives the rail in a suitable manner is used for generating the oscillating motion.

Further features, details and advantages of the invention are disclosed in a description hereinbelow of a preferred embodiment and by reference to the accompanying drawing, in which:

FIG. 6 is a section in the region of the stripper along the plane of the drawing according to FIG. 1 and FIG. 7 is a section along the line VII—VII according to FIG. 6.

Figure 1:
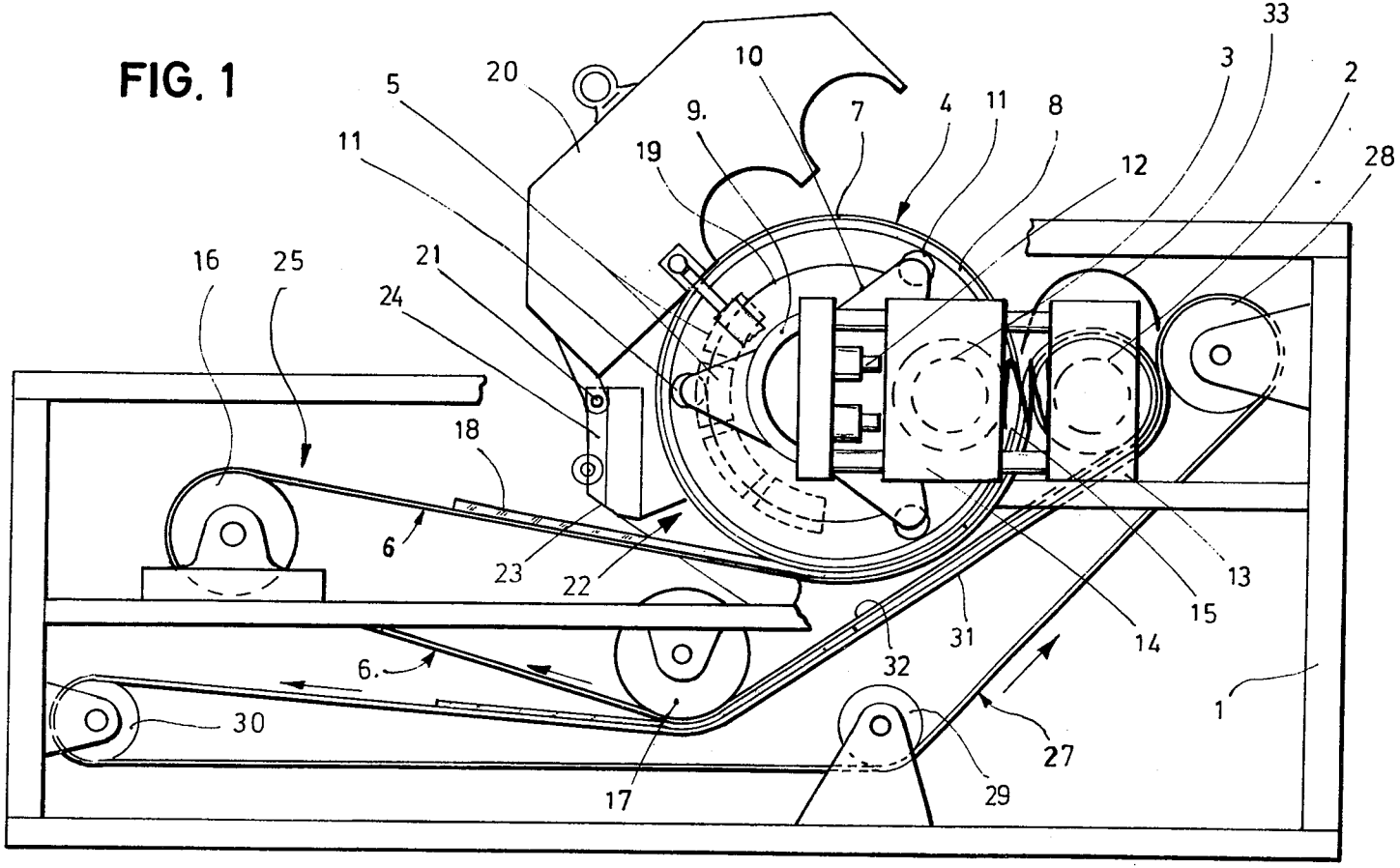
FIG. 1 is a diagrammatic side view of an ironing machine.

The ironing machine substantially comprises a pressure roller 2, a counter pressure roller 3, a hollow cylinder 4 which forms the ironing surface, a heating device 5 and an endless feed belt 6. These parts are arranged on a common machine frame 1.

The hollow cylinder 4 consists of thin sheet metal 7 functions as the ironing surface its external surface being therefore polished or, in the case of an embossing cylinder, provided with an embossing pattern. Rings are provided at least of the endfaces of the cylinder 4, for stiffening the ironing surface. A stationary tubular carrier 9 is disposed within the hollow cylinder 4 along its axis and supports on its two ends a spider 10 with guide rollers 11. The rollers retain the hollow cylinder in a position which is central with respect to its axis. The tubular carrier is fixed to the frame 1 on only one endface of the hollow cylinder 4.

The counter pressure roller 3, already indicated, is situated in the interior of the hollow cylinder 4 and rolls upon the internal wall thereof. Together with the externally disposed pressure roller 2 it forms the actual ironing zone through which the hollow cylinder 4 is guided. The pressure roller 2 is urged towards the counter pressure roller 3 by hydraulic or pneumatic jacks 12 to provide the desired ironing pressure, for which purpose the bearing pedestal 13 of the pressure roller 2 is slidingly seated upon the machine frame 1. The pedestal 14 of the counter pressure roller 3 is fixed to the carrier 9 or to the spiders 10, respectively. The yoke for the jacks 12, the pullong bars (unnumbered), and the pedestal 13 are joined together as one piece and are movable by means of the pulley bars sliding in corresponding holes in the pedestal 14. The required restoring force is produced by a spring 15 which is inserted between the two bearing pedestals 13 and 14.

The pressure roller 2 also functions as a reversing pulley on the delivery side for the endless web-shaped feeder belt 6 which is also guided over a reversing pulley 16 on the feed side and over a drive roller 17. The said feed belt 6 surrounds the hollow cylinder 4 approximately in the region of its right-hand bottom quadrant and is guided through the ironing zone formed between the pressure roller 2 and the counter pressure roller 3. A sheet of material such as leather 18, situated on the feed belt 6, first passes into the zone of contact described above. The appropriate section of the hollow cylinder 4 has the desired high temperature which is produced in the preceding sector by radiant heating means 5. The leather is therefore first heated in the zone of contact before reaching the ironing zone. The heating device extends axially through the entire interior space of the hollow cylinder 4 and can be mounted, for example, on the endface discs 19 of the tubular carrier 9.

The hollow cylinder 4 (FIG. 1) is covered, at least on its top, by a hood 20 which can be swung open about a bearing 21. During the ironing operation, the hood is closed to enable the heat to be built up,. The hood 20 can then be opened for cooling purposes or for lowering the treatment temperature. A sheet metal plate 23 which on the one hand serves as a guard and on the other hand extends close to the hollow cylinder 4 is situated in the inlet region 22 of the feed belt 6 so that air convection between the housing 24 or the hood 20 and the hollow cylinder is almost eliminated. The said plate 23 can also be swung open for cooling the hollow cylinder by pivoting around the bearing 21 clockwise.

The leather which leaves the ironing machine at the pressure roller 2 (FIG. 1) can be either removed at that place or can be transferred to another conveyor. Instead, the leather can also be returned to the feed side to which end a return belt 27 is included in the illustrated embodiment. The return belt incorporates a pulley 28 in the back of the machine, a turning pulley 29 and a delivery pulley 30 which is situated near the feed side of the feed belt. The upper stringer — the feed stringer 31 — of the said return belt 27 is in contact with the return stringer 32 of the feed belt 6, at least as far as the turning pulley 17. It then extends at a more shallow level than the return stringer of the feed belt 6. The leather which emerges from the ironing zone is introduced by a guide plate 33 into the gap between the presure roller 2 and the reversing pulley 28 and, due to friction between the return stringer 32 of the feed belt 6 and the feed stringer 31 of the return belt 7, it is guided downwardly as far as the drive pulley 17 and from there is conveyed only by the feed stringer 31 to the reversing pulley 30 where the leather can be removed by the operator who feeds the leather.

Figure 2:
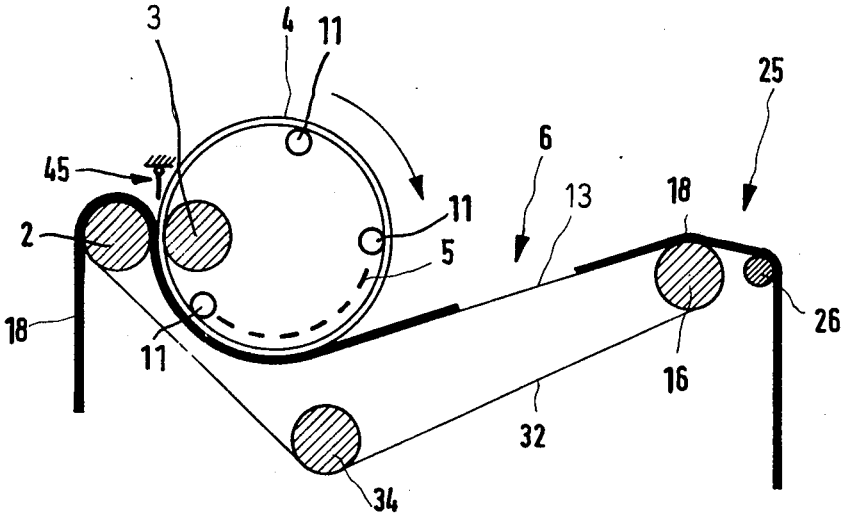
FIG. 2 is a side view of the ironing machine with specific schematic features for the reverse direction of operation and without a return belt but with retaining means for the leather.

The ironing machine shown in FIG. 2 also comprises an ironing rollers 4, two pressure cylinders 2, 3, a feed belt 6 and two turning pulleys 16 and 34. A heating system 5 and support rollers 11 are also arranged within the ironing cylinder 4. The entire skin 18 is laid on the feed belt 6 with the leading section in the region of the feed place 25 and is guided between the ironing roller 4 and the pressure roller 2 illustrated on the left-hand side of the drawing.

Figure 3:
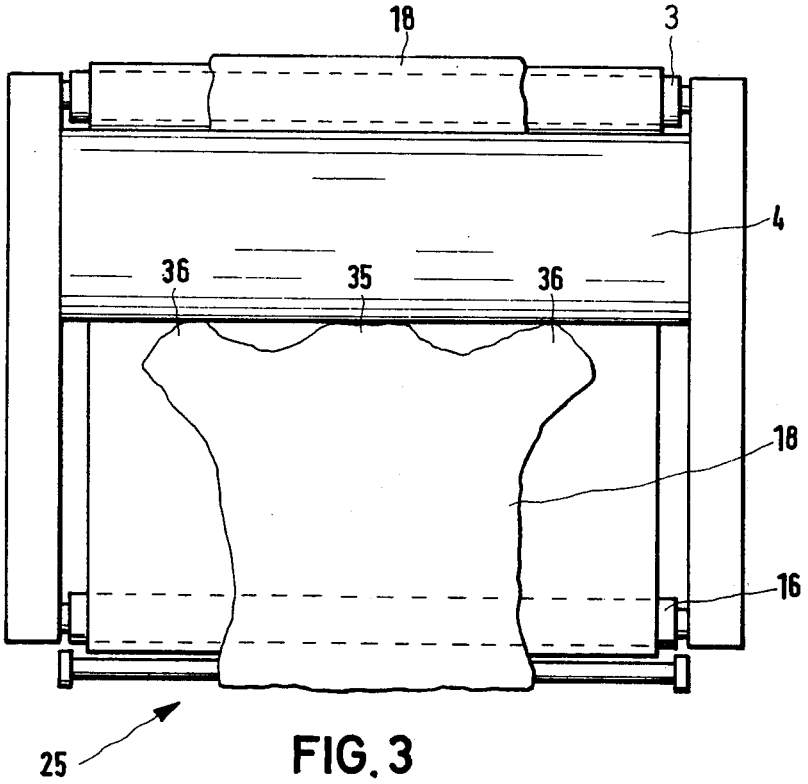
FIG. 3 is a plan view of the machine according to FIG. 1.

FIG. 3 shows the skin 18 diagrammatically in plan view. The skin is fed in the direction of its longitudinal extent so that the tail part 35 and the rear leg parts 36 enter the processing gap first.

Figure 4:
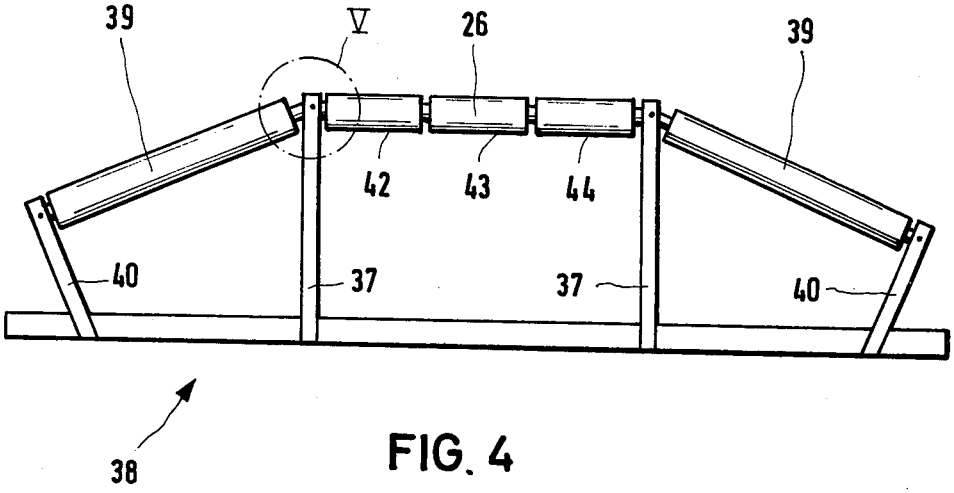
FIG. 4 is a view of the frame for the retaining cylinders and side rollers.
Figure 5:
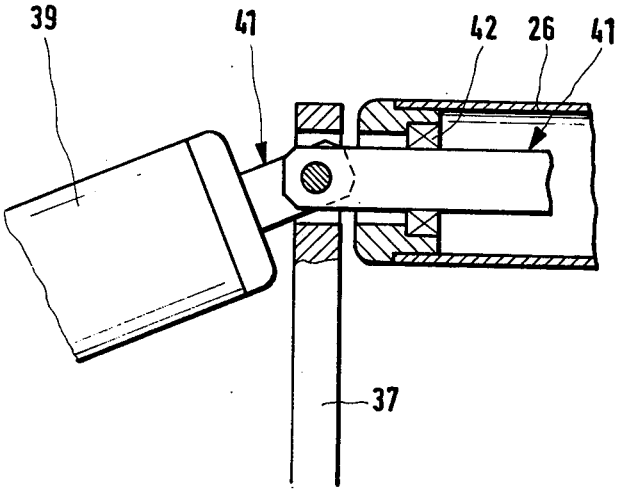
FIG. 5 shows the detail V according to FIG. 4 to an enlarged scale.

As can be seen by reference to FIG. 2, the return stringer 32 of the conveyor belt 6 is guided from below around the turning pulley 16 in the region of the feed station 25 and the leading stringer leaves the turning pulley in the approximately horizontal or slightly falling direction. A retaining roller 26 is arranged directly in front of the turning pulley 16, i.e. at a slight distance thereform. As shown in FIG. 4, the retaining roller 26 is supported on the uprights 37 of a frame 38. In the illustrated embodiment, the retaining roller 26 extends only over the middle region of the turning pulley 16. Side rollers 39, inclined at an outwardly downward angle, are arranged between the retaining roller 26 and the outer ends of the turning pulley 16. The inner ends of the said side rollers are supported on the uprights 37 and the outer ends are supported on the uprights 40 of the frame.

The retaining roller 26 and the side rollers 39 are situated on different shaft sections 41 which are angularly related in the region of the uprights 37 in accordance with the angle of downward inclination of the side rollers 39. The retaining roller 26 and the side rollers 39 are freely rotatable on the shaft 41 by means of radial bearings 42. As indicated in FIG. 4, the retaining roller 26 can also be subdivided into several sections, for example three sections 42, 43 and 44, each section in turn being loosely supported on the middle shaft section 41.

FIG. 2 indicates a stripper 45 behind the ironing gap, i.e. behind the ironing cylinder 4 and the outer pressure roller 2, and it should be noted that the said stripper is not identical with the guide plate 33 in the embodiment of FIG. 1. As may be seen by reference to FIGS. 6 and 7, the stripper 45 comprises several stripper fingers 46 which extend over the entire processing length width of the machine. In the illustrated embodiment, the stripper fingers 46 are situated on leaf springs 47 which in turn are mounted on a rail 48. The stripper fingers 46 consists of a material, for example PTFE, which is on the one hand sufficiently soft so as not to damage the highly polished ironing cylinder but on the other hand is sufficiently thermally stable.

The rail 48 is mounted on a hollow section 49. A motor 50 whose shaft 51 engages in the hollow section 49 and is provided at the end with an eccentric device 52, is situated on the hood 20 which is illustrated in FIG. 7 but is omitted from FIG. 2 in the interests of clarity. The eccentric device 52 is situated with slight clearance between two webs 53 which are mounted on the hollow section 49. The hollow section 49 is supported on a sliding member 54 which is secured to the hood 20 by means of an arm 55.

We claim:

1. A machine for applying treatments such as ironing, embossing and the like to sheet materials, comprising:

a rotatable, thin-walled hollow cylinder with a treating surface;

a pressure roller adjacent to the treating surface of the hollow cylinder;

a conveyor means passing between the treating surface and the pressure roller for guiding the sheet material therebetween;

radiant heating means associated with the hollow cylinder for heating the treating surface; and a counter-pressure roller arranged within the hollow cylinder so as to roll on the internal wall surface of the hollow cylinder and, together with the pressure roller, serving to guide the hollow cylinder, the conveyor means and the sheet material in a gap between the roller.

2. A machine according to claim 1, wherein the radiant heating means is arranged internally of the hollow cylinder.

3. A machine according to claim 1, wherein the radiant heating means is arranged externally of the hollow cylinder.

4. A machine according to claim 1, wherein pulleys are provided for guiding the conveyor means to bear upon the hollow cylinder over at least about one-fourth of the circumference of the hollow cylinder.

5. A machine according to claim 1, wherein the radiant heating means is located on a circular arc spaced from the internal wall surface of the hollow cylinder.

6. A machine according to claim 1, wherein the radiant heating means is disposed, in relation to the direction of rotation of the hollow cylinder, directly before the region in which the material comes into engagement with the hollow cylinder.

7. A machine according to claim 6, wherein the radiant heating means is located on a circular arc spaced from the internal wall surface of the hollow cylinder.

8. A machine according to claim 1, wherein guide rollers supported by bearings are provided for rotatably supporting the hollow cylinder, and a carrier is disposed along the axis of the hollow cylinder and supported at one end of the hollow cylinder for supporting the bearings and radiant heating means.

9. A machine according to claim 1, wherein the hollow cylinder is guided centrally with respect to its axis by stationary guide roller means.

10. A machine according to claim 1, wherein a pivotably mounted hood is provided for covering at least the top of the hollow cylinder.

11. A machine according to claim 10, wherein pivotable plate means extend into a gap between the hood, on the one hand, and the conveyor means and the hollow cylinder, on the other hand, and is disposed in the inlet region of the sheet material between the hollow cylinder and the conveyor means.

12. A machine according to claim 1, wherein the conveyor means for the material approaches from below the feed position of the material, and a turning roller is provided for turning the conveyor means into an approximately horizontal direction.

13. A machine according to claim 12, wherein a retaining roller which extends axially over at least the middle region of the turning roller is disposed directly in front of the turning roller at the material feed position.

14. A machine according to claim 13, wherein a side roller extends outwardly from each endface of the retaining roller.

15. A machine according to claim 14, wherein the outwardly extending rollers are downwardly inclined in the direction from the retaining roller to the outside.

16. A machine according to claim 15, wherein a common frame is provided for supporting the retaining rollers and the side rollers.

17. A machine according to claim 16, wherein the retaining roller and side rollers are supported on separate shaft sections which are angularly related in the region of the side rollers and the endfaces of the retaining roller, the sections being supported on the frame between the rollers.

18. A machine according to claim 13, wherein the retaining roller is comprised of at least two rotatably supported sections.

19. A machine according to claim 1, wherein resiliently supported stripper means is provided for detaching the material from the hollow cylinder rearwardly of the gap between the rollers.

20. A machine according to claim 19, wherein the stripper means comprises stripper fingers which are distributed over the processing width of the hollow cylinder, and means operatively associated with the stripper means are provided for driving the fingers in an oscillating path parallel to the axis of the hollow cylinder.

21. A machine according to claim 20, wherein the stripper fingers are mounted on a common rail extending over the processing width, and the rail being operatively connected with the driving means for movement in the oscillating path.

22. A machine according to claim 21, wherein leaf springs are mounted on the common rail, and the stripper fingers are mounted on the leaf springs.

23. A machine according to claim 20, wherein the driving means comprises a rotatable eccentric member associated with the rail.

* * * * *